United States Patent [19]

Mueller

[11] Patent Number: 4,765,491

[45] Date of Patent: Aug. 23, 1988

[54] DEVICE FOR SUPPORTING FIREWOOD STACK

[76] Inventor: Dan P. Mueller, 26125 Pierce Rd., Los Gatos, Calif. 95030

[21] Appl. No.: 52,976

[22] Filed: May 22, 1987

[51] Int. Cl.[4] ..... A47F 7/00

[52] U.S. Cl. ..... 211/49.1; 211/182; 211/195

[58] Field of Search ..... 211/49.1, 60.1, 70.4, 211/85, 195, 192, 42, 43, 182

[56] References Cited

U.S. PATENT DOCUMENTS

| | | | |
|---|---|---|---|
| 1,238,571 | 8/1917 | Rosenthal | 211/182 X |
| 1,598,467 | 8/1926 | Weeks | 211/42 X |
| 2,956,763 | 10/1960 | D'Arca | 211/195 X |
| 3,861,695 | 1/1975 | Shourek et al. | 211/195 X |
| 4,129,916 | 12/1978 | Schlesinger et al. | 211/182 X |
| 4,600,108 | 7/1986 | Scott et al. | 211/49.1 |

FOREIGN PATENT DOCUMENTS

| | | | |
|---|---|---|---|
| 6612108 | 8/1966 | Netherlands | 211/70.4 |

*Primary Examiner*—J. Franklin Foss
*Assistant Examiner*—Sarah A. Lechok Eley
*Attorney, Agent, or Firm*—Gerald L. Moore

[57] ABSTRACT

A device [9] for supporting the end of a firewood stack and the like including a first pair of elongated members [14,15] fixed together by a first cross piece [16] and fixed to a base [19] by a hinge [17] with a third elongated member [27] extending between and fixed to the first cross piece and one end of the base.

4 Claims, 2 Drawing Sheets

DEVICE FOR SUPPORTING FIREWOOD STACK

BACKGROUND OF THE INVENTION

1. Field of the Invention

This invention relates to a compact foldable device for supporting the end of a firewood stack.

2. Description of the Prior Art

Firewood is best stored in stacks wherein pieces are placed in rows on top of each other in a parallel relationship. This stacking method allows air to readily circulate between the firewood pieces for drying out the wood, partially prevents rain water from soaking the wood and provides for neatness and order in a minimum of space. For such stacking, there has been developed over the years methods of using the firewood itself to support the ends of the stack by placing the pieces in predetermined patterns. There also has been devised structures for supporting the stack ends, but the usual difficulties that such devices have presented include problems of storage in the summer time when not used and limitations in the amount of wood that they hold.

It is the purpose of the present invention to provide a stacking device which efficiently and effectively supports the end of a firewood stack while allowing for variable quantities of wood, and which also is foldable into a compact and easily storable form.

SUMMARY OF THE INVENTION

A device for supporting a firewood stack and the like including a pair of elongated members joined by a cross piece to form an upright assembly attached at one end to a base so as to extend perpendicular therefrom. The wood is stacked against one side of the upright assembly and on the base, while a diagonal member extends from the upright to the opposite end of the base to support the upright. The upright and diagonal are attached to each other and to the base in a manner to allow folding of the device for storage.

DESCRIPTION OF PREFERRED EMBODIMENTS OF THE INVENTION

Figure 1:
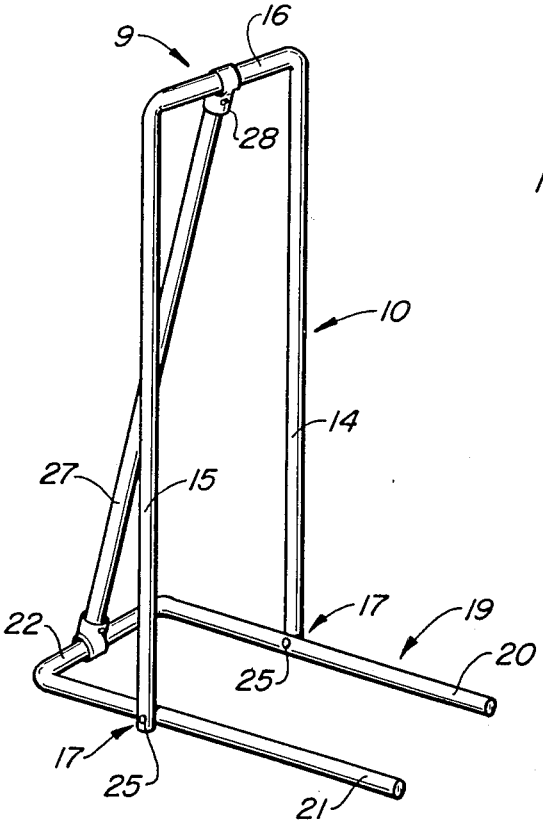
FIG. 1 is a perspective view of a first embodiment of the stacking device.

In FIG. 1 is shown the first embodiment of the invention in the form of a stacking device 9 comprising an upright assembly 10 fixed to a base assembliy 19 for supporting one end of a stack 11 (FIG. 2) of firewood or the like. The device comprises a pair of upright members 14 and 15 joined at one end by a cross piece 16 and joined at the other end by hinge means 17 to a base 19. In the same manner as the upright members, the base comprises a pipe bent in a "U" configuration to form a pair of extending legs 20 and 21 joined by a cross piece 22. The hinges 17 each comprises a pin or bolt 25 extending through holes in the ends of the upright members 14 and 15 and the base member legs 20 and 21.

Figure 2:
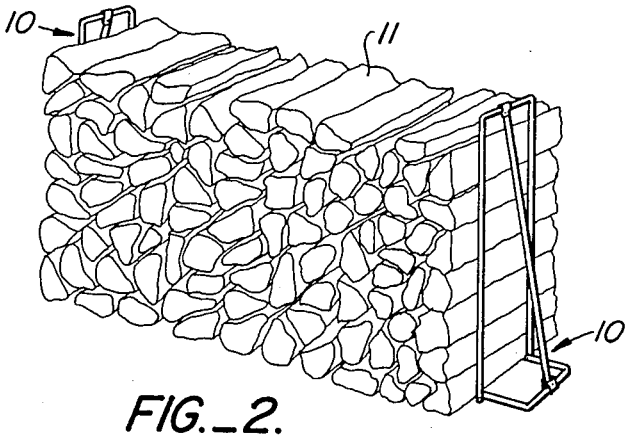
FIG. 2 shows the stacking device used to support a stack of firewood.

Thus the device can be manipulated to the form shown in FIG. 1 wherein the base 19 extends perpendicular to the upright member 10, and a brace 27, fixed to the cross piece 16 by hinge means 28, extends downward to the base cross piece 22. Thus as shown in FIG. 2, the firewood is stacked against the upright 10 on the side opposite the diagonal brace 27. With the firewood resting on the extending ends of the base members 20 and 21, the device is maintained in place with the upright 10 supporting the end of the firewood stack 11 and being held in the vertical, upright position by the brace 27. The other end of the firewood stack is supported by a similar stacking device or can be positioned against a tree, post or other available vertical surface or structure. Holes (not shown) can also be provided in the base 19 for attachment to an additional plate (not shown) to space the wood from the floor.

Figure 3:
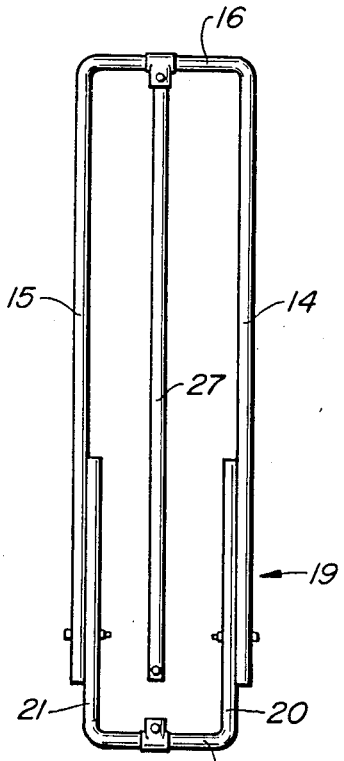
FIG. 3 shows a stacking device folded for storage.

When not in use, the device can be folded into the mode shown in FIG. 3, wherein the base is pivoted until the elongated members 20 and 21 extend parallel to and in the same plane as the elongated member 14 and 15, respectively. In this mode the diagonal brace 27 is also placed in a position between the elongated members 14 and 15 in a planar configuration for easy hanging or storage.

Figure 4:
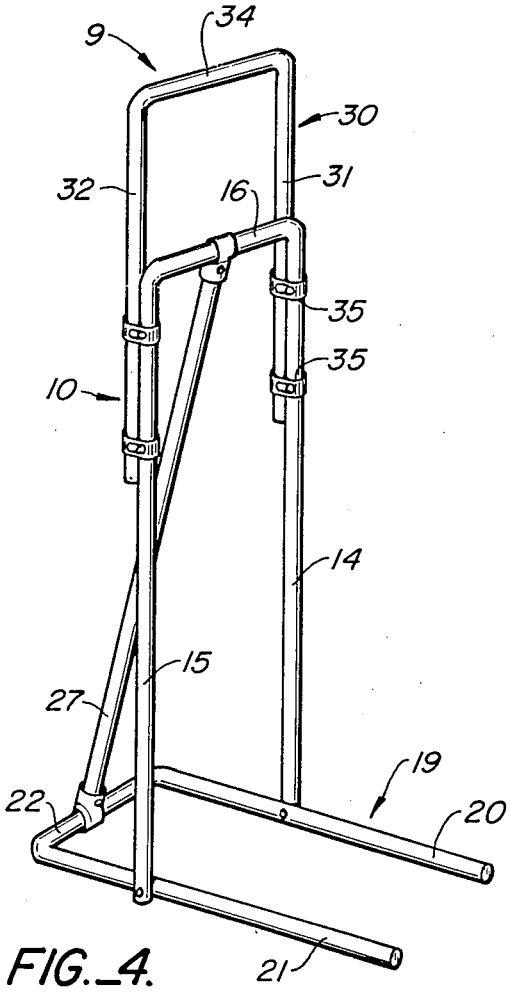
FIG. 4 is a second embodiment of the invention.

A second embodiment of the invention is shown in FIG. 4 which comprises the upright 10 and the base 19 with the elongated members 14 and 15 connected by the cross piece 16. The base 19 comprises the members 20 and 21 with the cross piece 22. In order to accommodate higher stacks of wood there is fixed to the upright a second upright 30 comprising elongated members 31 and 32 bent in a "U" configuration to form a cross piece 34. The elongated members are fixed to the upright by clamps 35 which can be of the standard hose clamp design.

Figure 5:
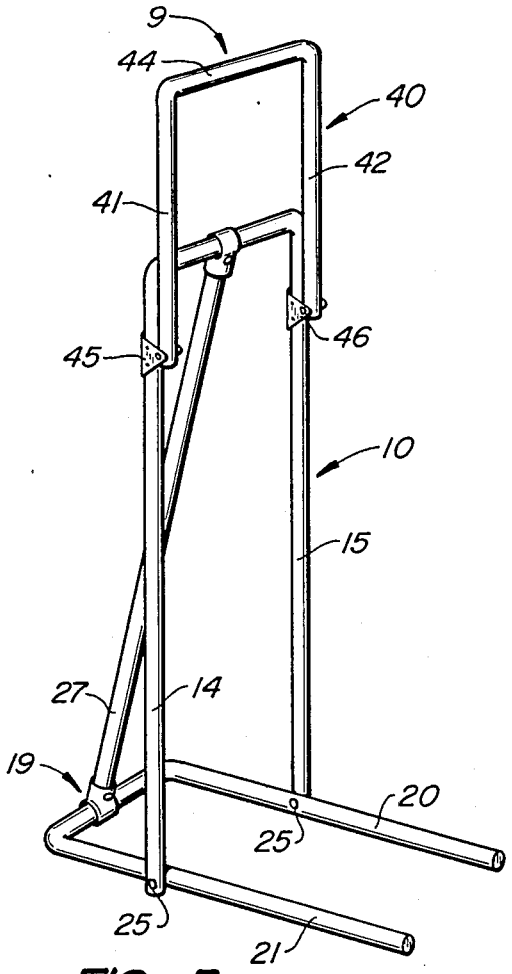
FIG. 5 is a third embodiment of the invention.
Figure 6:
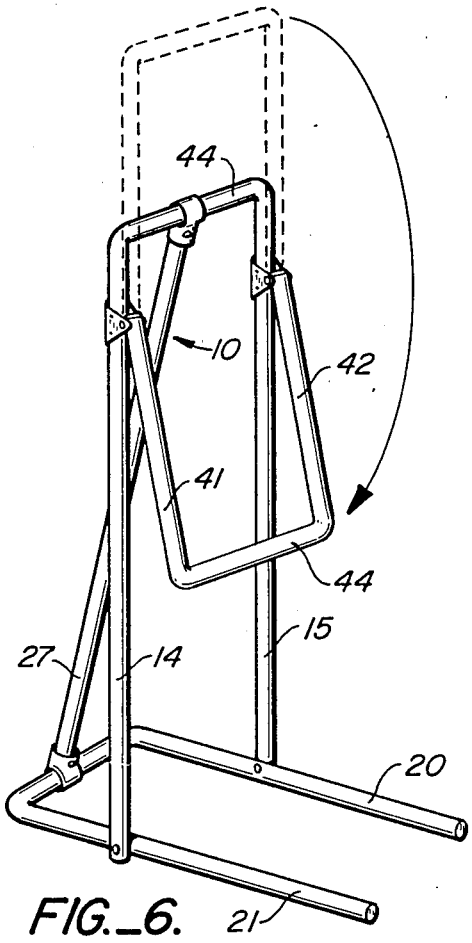
FIG. 6 shows the device of FIG. 5 with the extension folded downward when not needed.

Still a third embodiment is shown in FIG. 5 comprising the device 9 described in FIG. 1 having upright members 14 and 15, diagonal brace 27 and base 19. In this instance a second upright 40 is shown formed of a single pipe member bent in a "U" configuration to form elongated members 41 and 42 and a cross piece 44. The elongated members 41 and 42 are fixed to the upright members 14 and 15, respectively, by brackets 45 and 46 fixed between the members 14 and 41, and 15 and 46, respectively. In this manner the second upright can be folded downward to the position shown in FIG. 6 when not needed or for storage.

Figure 7:
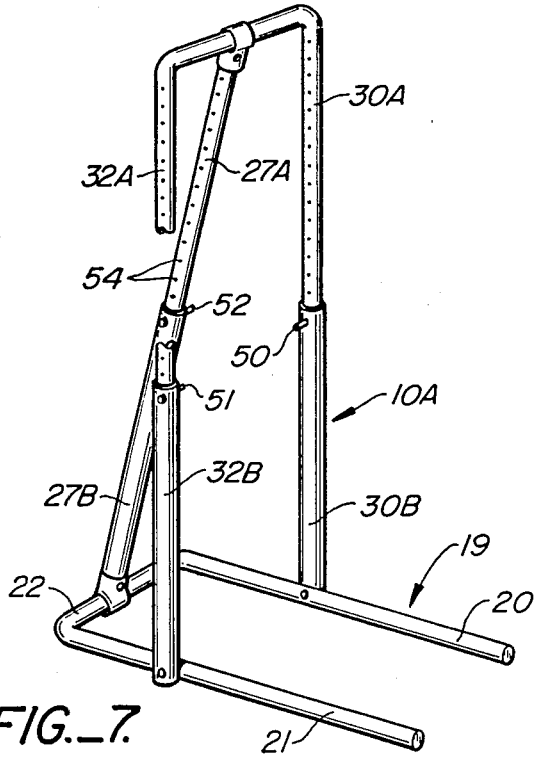
FIG. 7 shows a fourth embodiment of the invention.

Shown in FIG. 7 is yet another embodiment of the invention comprising a base 19 having elongated base members 20 and 21 connected by a crosspiece 22. In this embodiment the upright 10A is made adjustable in height by the fifth or upper elongated members 30A and 32A telescoping into lower elongated members 30B and 32B respectively, held there by bolts 50 and 51 passing therethrough. The diagonal also is comprised of the telescoping pieces 27A and 27B held by a bolt 52. Additional holes 54 in the upper members allows a choice of the height of the stacking device.

I claim:

1. A device for supporting firewood stacks and the like, comprising:

a pair of first elongated members each having two ends;

a first cross piece joining said first elongated members near one end and holding them in the same plane;

hinge means;

a planar base having two ends and formed of a pair of second elongated members each fixed to one of each of said first elongated members by said hinge means at a point intermediate the base ends;

a third elongated rigid member extending between and fixed to said first cross piece and one end of said base to hold said first elongated members substantially perpendicular to said base so that when said base is placed on the floor said first elongated members extend upward to serve as the end brace for a stack of wood or the like; and a second cross piece joining said second elongated members and releasably joined to said third elongated member to allow said device to be folded into a planar configuration for storage.

2. A device as defined in claim 1 including means for extending the length of said pair of first elongated members to increase the height of said device.

3. A device as defined in claim 2 wherein said means to increase the height of said first elongated members includes a fourth elongated member attached to each of said first elongated members.

4. A device as defined in claim 2 wherein said means to increase the height of said first elongated members includes fifth elongated members telescoped into said first elongated members.

* * * * *